US006863054B2

(12) United States Patent
Reiter et al.

(10) Patent No.: US 6,863,054 B2
(45) Date of Patent: Mar. 8, 2005

(54) FUEL INJECTION SYSTEM

(75) Inventors: Ferdinand Reiter, Markgröningen (DE); Martin Maier, Möglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,840

(22) PCT Filed: Jul. 23, 2002

(86) PCT No.: PCT/DE02/02696

§ 371 (c)(1),
(2), (4) Date: Oct. 23, 2003

(87) PCT Pub. No.: WO03/027492

PCT Pub. Date: Apr. 3, 2003

(65) Prior Publication Data

US 2004/0045531 A1 Mar. 11, 2004

(30) Foreign Application Priority Data

Sep. 13, 2001 (DE) ..... 101 45 035

(51) Int. Cl.[7] ..... F02M 55/02
(52) U.S. Cl. ..... 123/470; 123/456
(58) Field of Search ..... 123/470, 456, 123/467, 468, 469, 472, 490

(56) References Cited

U.S. PATENT DOCUMENTS 5,167,213 A * 12/1992 Bassler et al. ..... 123/470
5,220,301 A * 6/1993 Haas et al. ..... 335/278
5,301,647 A * 4/1994 Lorraine ..... 123/470
5,358,181 A * 10/1994 Tani et al. ..... 239/409
5,372,113 A * 12/1994 Smith ..... 123/470
5,724,946 A * 3/1998 Franchitto ..... 123/470
5,927,726 A 7/1999 Achenbach et al.
5,979,786 A * 11/1999 Longman et al. ..... 239/5
5,983,865 A * 11/1999 Yamashita et al. ..... 123/472

FOREIGN PATENT DOCUMENTS

| | | |
|---|---|---|
| DE | 196 00 378 | 7/1997 |
| DE | 199 02 186 | 7/2000 |
| EP | 0 501 612 | 9/1992 |
| JP | 02 163464 | 6/1990 |

* cited by examiner

*Primary Examiner*—Mahmoud Gimie
(74) *Attorney, Agent, or Firm*—Kenyon & Kenyon

(57) ABSTRACT

A fuel-injection system includes at least one fuel distributor and at least one fuel injector. The fuel distributor is embodied as an autonomous component and has a plurality of valve seats having several inner longitudinal openings in which the fuel injectors may be inserted. The valve seats, by their ends facing away from a fuel-supply channel of the fuel distributor, end in a freely exposed manner. At these ends of the valve seats at least one retaining element in each case is premolded or formed for the loss-proof mounting of the particular fuel injector. This fuel-injection system is particularly suited for the use in mixture-compressing internal combustion engines having external ignition.

12 Claims, 2 Drawing Sheets

FUEL INJECTION SYSTEM

BACKGROUND INFORMATION

From European Patent No. EP 0 501 612, a fuel injection system is already known in which a fuel-supply line is directly integrated in a valve seat. The valve seat, into which a fuel injector is insertable, is part of an intake manifold. The fuel system includes multiple-part manifolds which have flanges at their ends by which they are interconnected. The intake manifolds are either made of aluminum or plastic, and each of the valve seats usually surrounds a fuel injector with a radial clearance since, for instance, the fuel is supplied in the valve seats to fuel injectors embodied as so-called side-feed injectors. The fuel injectors are inserted into these valve seats in their fully assembled state. The fuel injector must be sealed in the valve seat by at least two sealing rings.

Furthermore, a fuel injection system is known from U.S. Pat. No. 5,568,798 in which a fuel-supply line is likewise integrated at an intake manifold. The fuel-supply line is in direct contact with a fuel injector to which the line supplies fuel. The fuel injector extends along a receiving orifice in the wall of the intake manifold and projects into it by its downstream end. The fuel-supply line includes an electrical line system, so that an electrical contacting of the valves takes place when the fuel injectors are inserted in the receiving bore.

Furthermore, from German Patent Application No. DE 196 00 378, a fuel-injection system is already known which is distinguished by an especially high integration of various components of the fuel injection. In this case, the fuel injection system includes at least one fuel injector and at least one intake manifold as well as a fuel-supply channel, all of which are provided with a plastic extrusion coat. The full integration of the fuel injectors at an intake-manifold system formed from plastic has the result that both electrical and hydraulic interfaces are reduced or avoided. Thus, this leaves only one compact component which is very easy to mount on a cylinder head of an internal combustion engine. Means for the electrical contacting of the fuel injectors, such as connecting plugs, are also fully integrated in the plastic extrusion coat. This complex component has the disadvantage, however, of being difficult to manufacture and handle in the plastic-extrusion process.

SUMMARY OF THE INVENTION

The fuel-injection system according to the present invention has the advantage over the related art that a considerable cost savings is achieved in a simple manner. Furthermore, the fuel-injection system is particularly easy to produce and install. Due to the fact that the various components of the fuel-injection system are only partially integrated, it is possible to separately produce the fuel distributor and the intake distributor with its intake manifolds, or a cylinder-head module, in a very simple and convenient manner. The full integration of the fuel injectors in a valve seat, which in each instance originates from the fuel distributor and hangs unsupported, has the result of reducing both electrical and hydraulic interfaces of the fuel-injection system and the space required for the fuel injectors. In an advantageous manner, retaining elements formed on the freely ending valve seats provide for a reliable and loss-proof positioning of the fuel injectors at the fuel distributor.

In order to secure the fuel injector, it is advantageous to provide at least one detent, facing radially toward the inside, on the end of the valve seat facing away from the fuel-supply channel of the fuel distributor. It is particularly advantageous if three such detents are formed at the valve seat.

An additional advantage is achieved in that the inner longitudinal opening, or the entire valve seat, has a contour that deviates from a cylindrical form. Here, especially a contour whose cross section resembles a dormer window is conceivable, that is, a circular design having at least one flattened region (closed u-shape).

It is particularly advantageous to integrate electrical lines for the joint electrical contacting of the fuel injectors in the fuel distributor, which is used to supply fuel to the fuel injectors. In this case, only one central plug is required for the electrical connection of the fuel-injection system to the outside.

DETAILED DESCRIPTION

Figure 1:
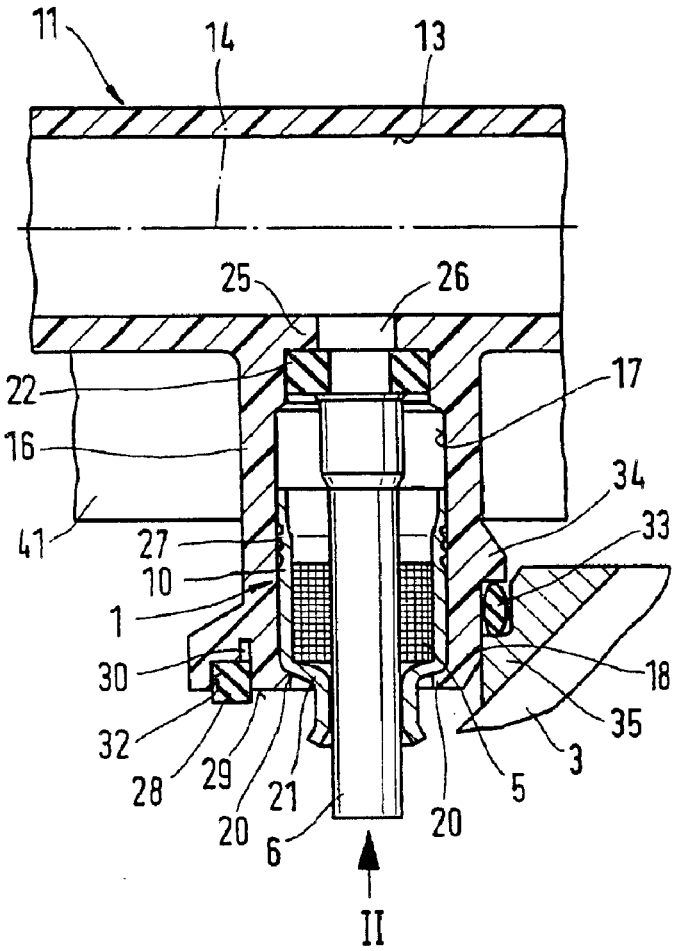
FIG. 1 shows a partial section through a fuel-injection system configured according to the present invention, with two variants of an embodiment of the seal.

FIG. 1 shows a partial section through a fuel-injection system which includes, among others, at least one fuel injector 1, the fuel-injection system being used especially as part of a fuel-injection system of mixture-compressing internal combustion engines having external ignition. In a sectional view, FIG. 1 shows only one fuel injector 1 in connection to an intake manifold 3, which is designed as a single intake manifold and leads to a combustion chamber (not shown) of the internal combustion engine. However, the fuel-injection system will usually be intended for an MPI (multi-point injection), in which, for instance, each combustion chamber of the internal combustion engine is assigned one fuel injector 1. Therefore, in an internal combustion engine having four combustion chambers (4-cylinder engine), four intake manifolds 3, extending in the direction of the combustion chambers, will extend in the fuel-injection system, each fuel injector 1 ending in an intake manifold 3. Via intake manifold 3, which, for example, has a circular cross section, intake air or recirculated exhaust gas are provided to the internal combustion engine. The control of the air quantity is implemented via a throttle organ (not shown) upstream from the orifice of fuel injector 1 in intake manifold 3.

So-called top-feed fuel injectors, for instance, in which the fuel is supplied via the end facing away from intake manifold 3, are suited as fuel injectors 1 for the use in the fuel-injection system according to the present invention. Fuel injector 1, shown only in simplified form, is activated in a known manner, for instance, electro-magnetically. For this reason, fuel injector 1 has an electromagnetic circuit which, among others, includes a magnetic coil 5, a core used as inner pole and an armature which is located inside an elongated, thin-walled and non-magnetic valve sleeve 6 and is not explicitly shown. Magnetic coil 5, embedded in a coil housing 7 (FIG. 4), surrounds valve sleeve 6, which extends over the entire valve length. Also inside tubular valve sleeve 6 is the actual valve group having a valve needle and a sealing seat. The electromagnetic circuit is used for the axial movement of the valve needle and, thus, the opening of the fuel injector, counter to the spring force of a restoring spring, or the closing of the fuel injector.

The fuel to be spray-discharged is metered, for instance, via a spray-orifice plate which is provided downstream from the sealing seat and which has at least one, for example four spray-discharge orifices 8 (FIG. 2), which are formed by eroding or stamping. Magnetic coil 5 is surrounded by a conductive element which is embodied as magnetic cup 10 and used as ferromagnetic element and completely surrounds magnetic coil 5 in the circumferential direction. By way of its lower end, it abuts against, and is rigidly joined to, valve sleeve 6.

By its inflow-side end, valve sleeve 6 is used as fuel-inflow nipple of fuel injector 1, the fuel being conveyed thereto from a fuel distributor 11. Fuel distributor 11, which is made of plastic, for instance, has an inner fuel-supply channel 13 having, for example, a circular or rectangular cross section. Branching off, for instance, mostly perpendicularly to longitudinal axis 14, from fuel distributor 11 and its fuel-supply channel 13, which extends along a longitudinal axis 14, are a plurality of valve seats 16 which have a nipple-type design and accommodate fuel injectors 1 in an internal longitudinal opening 17.

Valve seats 16 are freely suspended at fuel distributor 11, which means that they end freely in their regions facing away from fuel-supply channel 13 of fuel distributor 11 and do not directly transition into an intake manifold 3 or some other cylinder-head module in an integral manner. In order to position fuel injectors 1 at fuel distributor 11 in a reliable and loss-proof manner, at least one retaining element is provided at each end 18 of valve seat 16 facing away from fuel-supply channel 13 of fuel distributor 11. The retaining element is embodied, for instance, as a detent 20 directed radially inward. It is particularly advantageous if three such detents 20 are formed over the circumference of valve seat 16. Detents 20 reach under fuel injector 1, for instance, in the region of a cross-section tapering 21 of magnetic cup 10. Due to a certain elasticity of valve seat 16 and a radial expandability of detents 20, fuel injector 1 may be inserted by way of the free end of valve seat 16. After injector 1 has been inserted, more than 50%, ideally ⅔ to ⅘, of the overall length of fuel injector 1 extend inside longitudinal opening 17 of valve seat 16. Only a lower end of magnetic cup 10 and valve sleeve 6 with spray-discharge orifices 8 projects beyond valve seat 16 in an unprotected manner.

Fuel injector 1 is sealed from fuel distributor 11 by an axially sealing sealing element 22 which, on the one hand, is braced against the upper end of valve sleeve 6 of fuel injector 1 and, on the other hand, at a shoulder 25 formed between an inflow opening 26 in the wall of fuel distributor 11 and larger dimensioned longitudinal opening 17 of valve seat 16. To seal fuel injector 1 within longitudinal opening 17, magnetic cup 10 is provided with a plurality of circumferential ribs at its upper end, which function as labyrinth seal 27.

Figure 3:
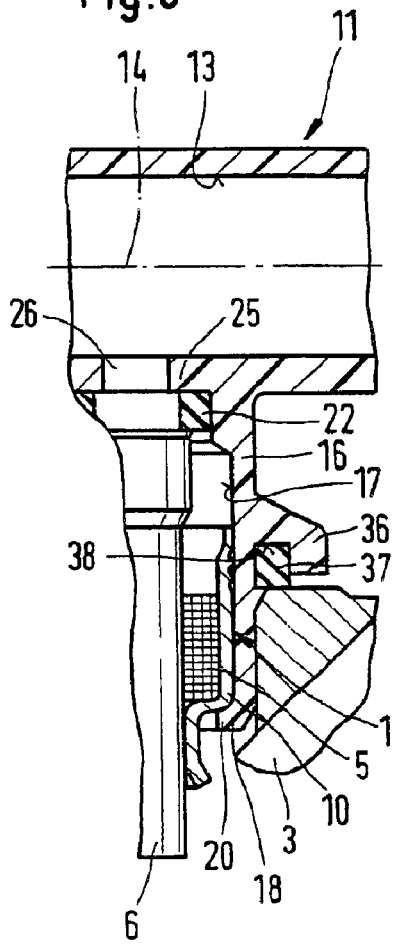
FIG. 3 shows a partial section through a fuel-injection system provided with a third variant of an embodiment of the seal.

Furthermore, FIGS. 1 and 3 show three different variants of an embodiment of the seal of valve seat 16 with respect to intake manifold 3 or some other cylinder-head module. Shown in FIG. 1 on the left side is an axial seal 28 which is inserted at the lower end face 29 of valve seat 16 in a sealing groove 32. Seal 28 has a round or rectangular cross section. At its end 18, valve seat 16 is widened in a flange-like manner as a result of such an axial seal 28 having been inserted. For better radial flexibility of detents 20, which are immediately adjacent at the same level, an axial recess 30 in the groove base of sealing groove 32 is useful.

Shown on the right side of FIG. 1 is a radial seal 33, which is expediently located at a step 34 at the outer circumference of valve seat 16. Step 34 corresponds to a step 35 of intake manifold 3, so that an annular space is formed for radial seal 33.

FIG. 3 shows a third variant of an embodiment of the seal in which a radial projection 36 is formed at the circumference of valve seat 16 which allows the insertion of an axial seal 37 at its lower end face, for instance, in a circumferential, groove-type depression 38. Seals 22, 28, 33 and 37 are embodied as elastomer seals, for example.

Figure 2:
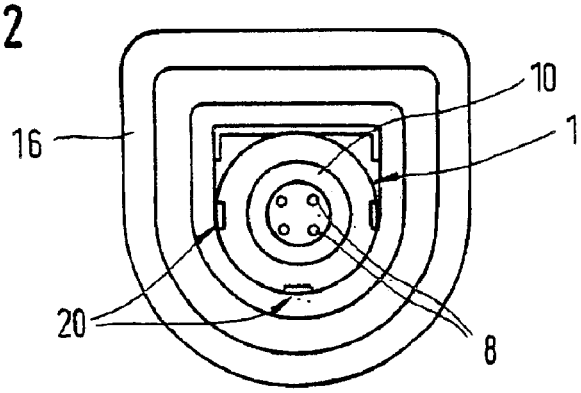
FIG. 2 shows a bottom view of the system in the direction of arrow 11 in FIG. 1.

FIG. 2 shows a bottom view of the fuel-injection system in the direction of arrow II in FIG. 1. It becomes clear here that inner longitudinal opening 17, or the entire valve seat 16, is advantageously designed with a contour that deviates from a cylindrical form. In this context, a cross section that resembles a dormer window, that is, a circular design having at least one flattened region (closed U-form) suggests itself. In this manner, a twisting protection for fuel injector 1 is obtained in a very simple manner, a precise installation position being defined from the beginning. Detents 20 are formed in the region of the circular outer contour. On the other hand, the electrical connection of fuel injector 1 may be formed in the region of the flattened outer contour of valve seat 16, as may be inferred from FIG. 4.

Figure 4:
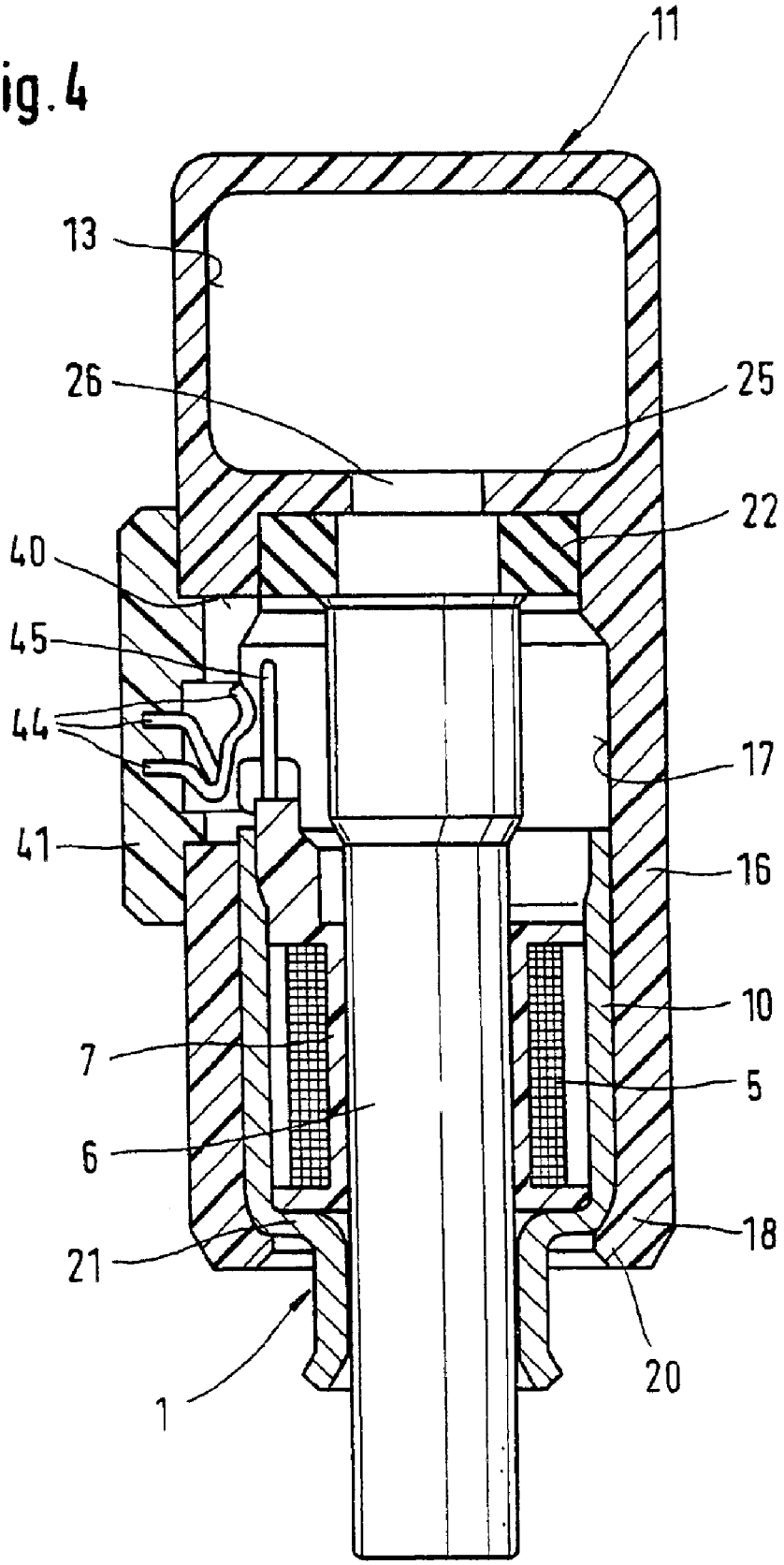
FIG. 4 shows a possibility for an electrical connection of a fuel injector to the fuel distributor.

FIG. 4 shows a view of the fuel-injection system that is rotated by 90° compared to FIGS. 1 and 3, this view illustrating an electrical connection possibility of fuel injector 1. In the region of its flattened outer contour, valve seat 16 has a lateral recess 40 through which the electrical contacting of fuel injector 1 takes place. The electrical contacting of the individual fuel injectors 1 is carried out via a contact bar 41 which interconnects all fuel injectors 1. Contact bar 41, made of plastic, in which all required electrical lines are integrated, constitutes an elongated, flat plate. At one contacting end of contact bar 41, a central connector (not shown) is attached, which, in the case of four fuel injectors 1 to be contacted, is designed as a five-pin plug, for example. The number of electrical lines provided in contact bar 41 is reduced by one for each fuel injector 1, up to fuel injector 1, located at the greatest distance, for which two electrical lines will still be provided. Contact bar 41 is fixedly and sealingly connected to fuel distributor 11 or valve seats 16 by ultrasound welding or laser welding. However, a clip connection is also conceivable as an alternative.

In the direction of fuel injectors 1, the electrical lines of contact bar 41 end in flexible connections 44 which project through recess 40 into longitudinal opening 17. These connections 44 correspond to the two contact pins 45 projecting beyond coil housing 7 of magnetic coil 5, thereby ensuring a reliable electrical contacting of fuel injector 1.

What is claimed is:

1. A fuel-injection system for an internal combustion engine comprising:

at least one fuel distributor having a fuel-supply channel;

at least one fuel injector;

at least one valve seat having an inner longitudinal opening into which the fuel injector is insertable, the at least one valve seat having an end facing away from the fuel-supply channel, the at least one valve seat, by the end, ending freely exposed, the at least one valve seat configured for insertion of the fuel injector through the freely exposed end; and at least one retaining element for the loss-proof mounting of the fuel injector inside the valve seat, the at least one retaining element being one of premolded with and formed on the end of the valve seat.

2. The fuel-injection system according to claim 1, wherein the at least one retaining element includes at least one detent directed radially inward.

3. The fuel-injection system according to claim 2, wherein the at least one detent includes three detents spaced at a distance from each other and formed at the valve seat.

4. The fuel-injection system according to claim 1, wherein the valve seat has a contour that deviates from a cylindrical form.

5. The fuel-injection system according to claim 1, wherein, to receive the fuel injector, the valve seat has an inner longitudinal opening which has a contour that deviates from a cylindrical form.

6. The fuel-injection system according to claim 5, wherein at least one of the valve seat and the inner longitudinal opening has a circular contour with at least one flattened region.

7. The fuel-injection system according to claim 1, further comprising a contact bar affixed to the fuel distributor and ending in a central connector, each of the at least one fuel injector being connected to electrical lines of the contact bar via which electrical contacting of the fuel injector is implemented.

8. The fuel-injection system according to claim 7, wherein the valve seat has a lateral recess through which electrical connections for the electrical contacting of the fuel injector are guided.

9. The fuel-injection system according to claim 1, further comprising at least one of an axial seal and a radial seal for sealing the valve seat from one of an intake manifold and another cylinder-head module.

10. The fuel-injection system according to claim 1, further comprising an axially-sealing sealing element for sealing the fuel injector from the fuel distributor, the sealing element being situated between a shoulder of the fuel distributor and an upstream end of the fuel injector.

11. The fuel-injection system according to claim 1, wherein, after an insertion and securing of the fuel injector in the valve seat, more than 50% of an overall length of the fuel injector extends inside the longitudinal opening of the valve seat.

12. The fuel-injection system according to claim 1, wherein the at least one valve seat extends from and is integral with the fuel distributor.

* * * * *